US006248044B1

(12) United States Patent
Stearns et al.

(10) Patent No.: US 6,248,044 B1
(45) **Date of Patent: *Jun. 19, 2001**

(54) ELLIPTICAL EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

This patent is subject to a terminal disclaimer.

(21) Appl. No.: 09/454,738

(22) Filed: Dec. 6, 1999

Related U.S. Application Data

(63) Continuation of application No. 09/245,508, filed on Feb. 5, 1999, now Pat. No. 5,997,445, which is a continuation-in-part of application No. 09/065,308, filed on Apr. 23, 1998, and a continuation-in-part of application No. 08/914,206, filed on Aug. 19, 1997, now Pat. No. 5,897,463, and a continuation-in-part of application No. 08/953,308, filed on Oct. 17, 1997, now Pat. No. 5,895,339.

(60) Provisional application No. 60/092,880, filed on Jul. 15, 1998, and provisional application No. 60/102,444, filed on Sep. 30, 1998.

(51) Int. Cl.[7] ..... A63B 22/00; A63B 69/16

(52) U.S. Cl. ..... 482/52; 482/51; 482/70

(58) Field of Search ..... 482/51–53, 57, 482/70, 79, 80

(56) References Cited

U.S. PATENT DOCUMENTS 5,895,339 * 12/1999 Maresh ..... 482/51
5,897,445 * 12/1999 Maresh et al. ..... 482/70
5,897,463 * 4/1999 Maresh ..... 482/70

* cited by examiner

*Primary Examiner*—Stephen R. Crow

(57) ABSTRACT

An exercise apparatus has a linkage assembly which is movably mounted on a frame and links rotation of left and right crank to elliptical movement of left and right foot supporting members. The linkage assembly includes left and right connector links having three discrete connection points. A first connection point on each connector link is rotatably connected to a respective crank. A second connection point on each connector link is constrained to move through a predetermined path relative to the frame. A third connection point on each connector link is connected to a first portion of a respective foot supporting link. A second portion of each foot supporting link is constrained to move through a predetermined path relative to the frame. The path of the foot supporting links may be altered by adjusting a first frame member relative to a second member.

7 Claims, 6 Drawing Sheets

ELLIPTICAL EXERCISE METHODS AND APPARATUS

CROSS-REFERENCE TO RELATED APPLICATION

This application is a continuation of U.S. patent application Ser. No. 09/245,508, filed on Feb. 5, 1999 (now U.S. Pat. No. 5,997,445), which in turn, is a continuation-in-part of the following U.S. patent applications: Ser. No. 08/914,206, filed on Aug. 19, 1997; Ser. No. 08/953,308, filed on Oct. 17, 1997; and Ser. No. 09/065,308, filed on Apr. 23, 1998. This application also discloses subject matter entitled to the filing dates of the following U.S. Provisional Applications: Ser. No. 60/092,880, filed on Jul. 15, 1998; and Ser. No. 60/102,444, filed on Sep. 30, 1998.

FIELD OF THE INVENTION

The present invention relates to exercise methods and apparatus and specifically, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically links a relatively simple motion, such as circular, to a relatively more complex motion, such as elliptical.

SUMMARY OF THE INVENTION

The present invention provides a novel linkage assembly and corresponding exercise apparatus suitable for linking circular motion of left and right cranks to elliptical motion of left and right foot supports. In general, left and right connector links have first connection points connected to respective cranks; second connection points operatively connected to the apparatus frame and constrained to move through a predetermined path relative thereto; and third connection points connected to first portions of respective foot supports. A second portion of each foot support is operatively connected to the apparatus frame and constrained to move through a predetermined path relative thereto. Additional features and/or advantages of the present invention will become apparent from the more detailed description that follows.

BRIEF DESCRIPTION 0F THE DRAWING

With reference to the Figures of the Drawing, wherein like numerals represent like parts and assemblies throughout the several views, FIG. 1 is a perspective view-of a first exercise apparatus constructed according to the principles of the present invention;

DETAILED DESCRIPTION OF THE PREFERRED EMBODIMENT

Figure 1:
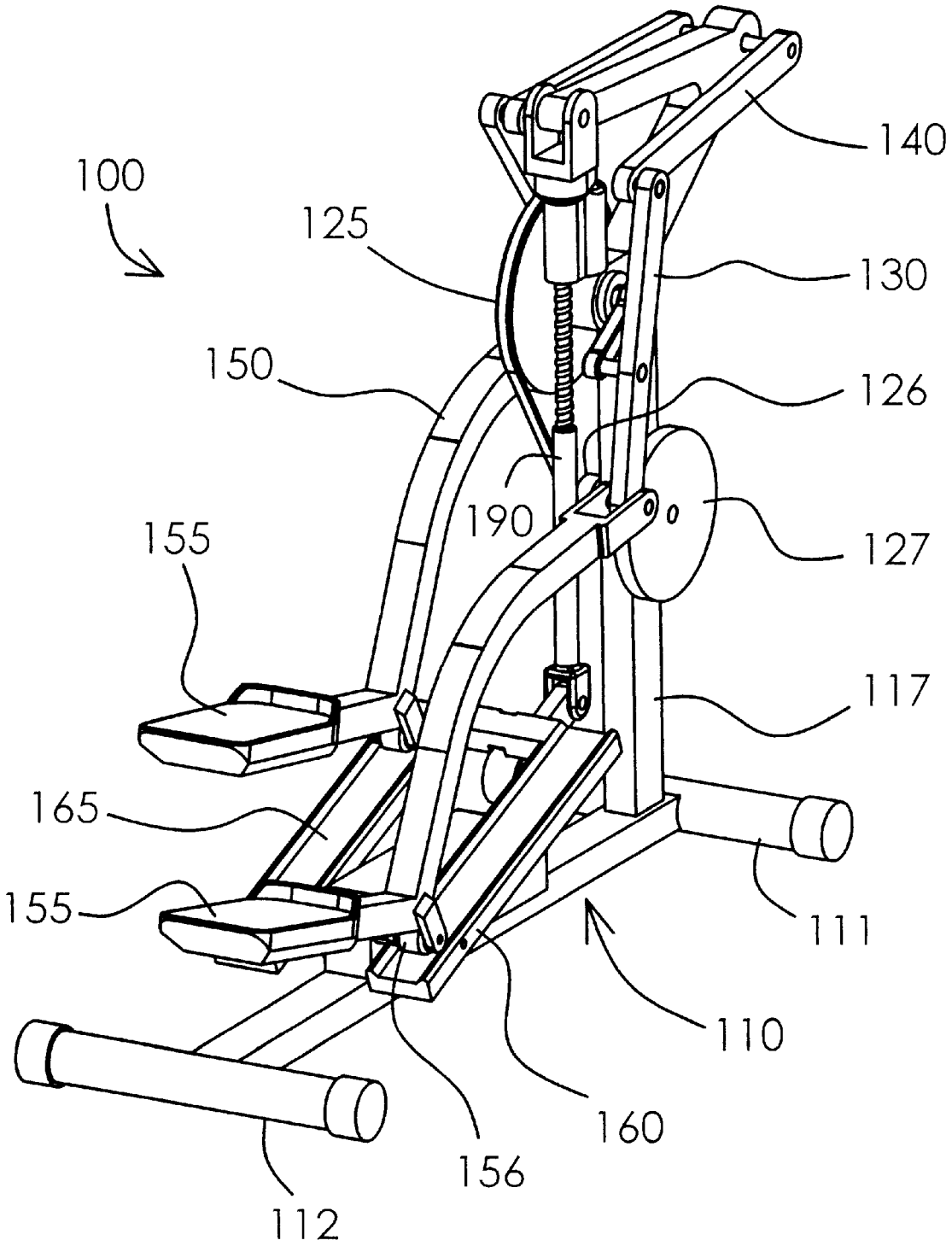
Figure 2:
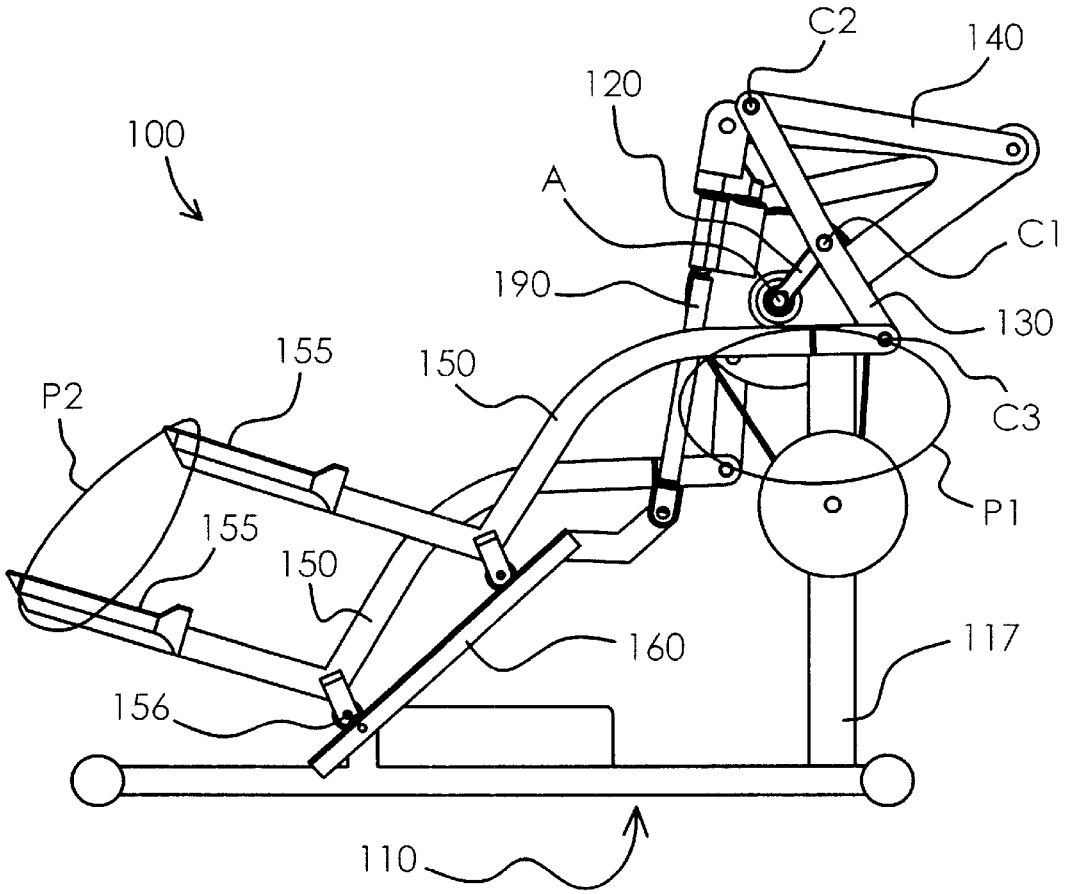
FIG. 2 is a side view of the exercise apparatus of FIG. 1, with a ramp portion occupying a relatively inclined orientation relative to an underlying floor surface.
Figure 3:
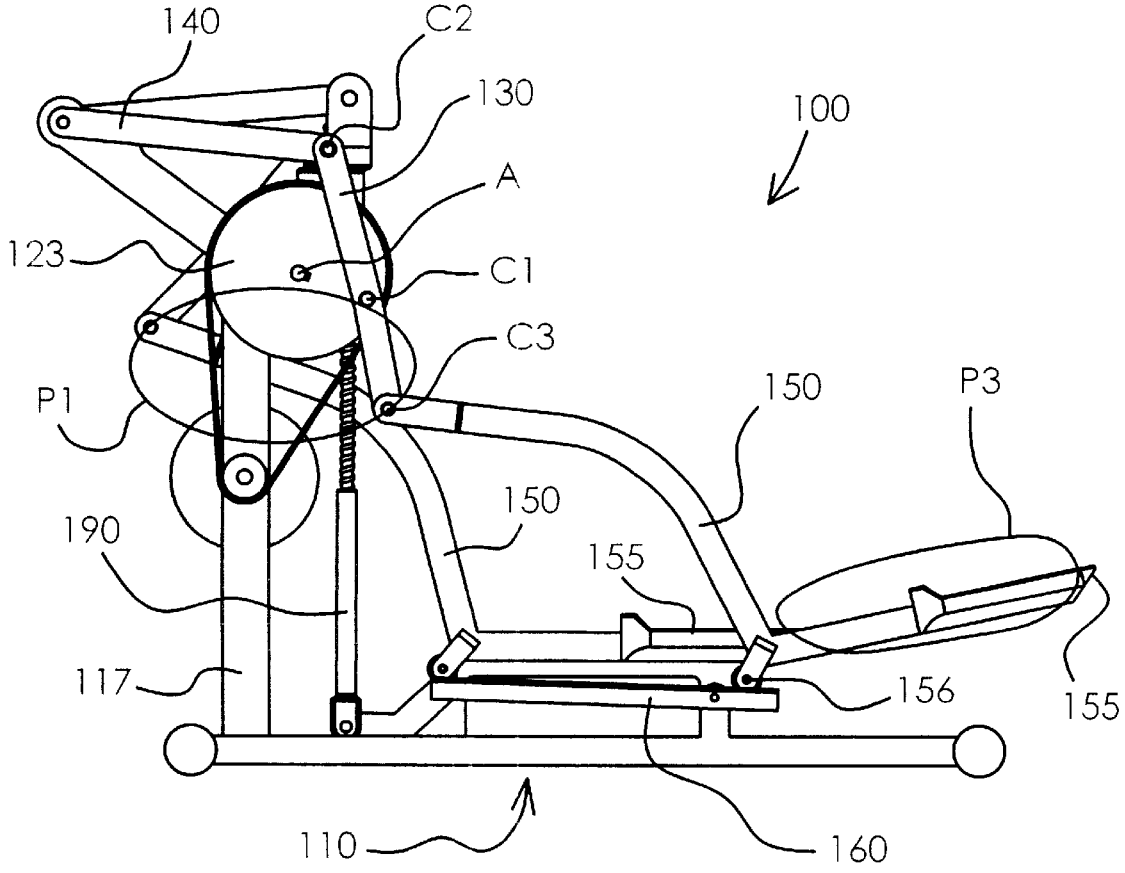
FIG. 3 is a side view of the exercise apparatus of FIG. 1, with a ramp portion occupying a relatively horizontal orientation relative to an underlying floor surface.

A preferred embodiment exercise apparatus constructed according to the principles of the present invention is designated as 100 in FIGS. 1–3. The exercise apparatus 100 generally includes a linkage assembly movably mounted on a frame 110. Generally speaking, the linkage assembly moves relative to the frame 110 in a manner that links rotation of left and right cranks 123 and 120 to elliptical motion of left and right force receiving members 155. The term "elliptical motion" is intended in a broad sense to describe a closed path of motion having a relatively longer first axis and a relatively shorter second axis (which is perpendicular to the first axis).

The frame 110 includes a floor engaging base having a forward transverse support 111 and a rearward transverse support 112 which stabilize the apparatus 100 relative to an underlying floor surface. A stanchion or upright support 117 extends upward from the base proximate the forward support 111.

For the most part, the apparatus 100 is symmetrical relative to a vertical plane extending lengthwise through the base (perpendicular to the transverse supports 111 and 112), and like reference numerals are used to designate like parts disposed on opposite sides of the apparatus 100. However, the "right-hand" components of the linkage assembly are one hundred and eighty degrees out of phase relative to the "left-hand" components of the linkage assembly.

The linkage assembly includes left and right cranks 123 and 120, left and right connector links 130, left and right rocker links 140, left and right foot supporting links 150, left and right rollers 156, and left and right tracks 165. The cranks 123 and 120 are rotatably mounted on opposite sides of the stanchion 117 via a common shaft. On the preferred embodiment 100, the left crank 123 is a relatively large diameter pulley, and the right crank 120 is a crank arm. As shown in FIG. 1, a relatively smaller diameter pulley 126 and a flywheel 127 are also rotatably mounted on opposite sides of the stanchion 117 via a common shaft. A belt 125 connects the large diameter pulley 123 to the small diameter pulley 126 to provide a "stepped-up" flywheel 127 which adds inertia to the linkage assembly. A drag strap or other known device may be connected to the flywheel 127 to provide an element of resistance.

As shown in FIGS. 2–3, each connector link 130 has three connection points C1, C2, and C3. The first connection point C1 on each connector link 130 is rotatably connected to a respective crank 123 or 120. As a result, the first connection point C1 on each connector link 130 is constrained to rotate, traveling in a circle centered about the crank axis A. The second connection point C2 on each connector link 130 is rotatably connected to a first end of a respective rocker link 140. An opposite end of each rocker link 140 is rotatably connected to the stanchion 117. As a result, the second connection point C2 on each connector link 130 is constrained to reciprocate, traveling through an arc relative to a pivot axis defined between the frame 110 and a respective rocker link 140.

The third connection point C3 on each connector link 130 is rotatably connected to a first portion of a respective foot supporting link 150. The size and configuration of the connector links 130 are such that each third connection point C3 is constrained to move through an elliptical path P1 disposed entirely beneath the crank axis A. In other words, the third connection points C3 travel through a predetermined range of distances from the crank axis A, and the third connection points C3 cannot be said to travel in an arcuate path about the crank axis A.

A left roller 156 is rotatably connected to a second portion of the left foot supporting link 150, and a right roller 156 is rotatably connected to a second portion of the right foot supporting link 150. Each roller 156 is supported by a respective underlying track 165 on the guide 160. As a result, each roller 156 is constrained to reciprocate, traveling linearly along a respective track 165. In other words, each roller 156 constrains a second portion of a respective foot supporting link 150 to move through a predetermined path. Those skilled in the art will recognize that the tracks 165 may be configured to provide alternative paths for reciprocal motion, including arcuate, for example.

A first, relatively rearward end of the guide 160 is rotatably connected to the frame 110. A second, relatively forward end of the guide 160 is rotatably connected to a lower end of an actuator 190. An opposite, upper end of the actuator 190 is rotatably connected to the stanchion 117. The actuator 190 is selectively operable to vary the inclination of the guide 160 relative to the frame. The actuator 190 may be operated at the discretion of a user and/or in response to signals received from a controller, as suggested by U.S. Pat. No. 5,685,804 to Whan-Tong et al., which is incorporated herein by reference.

Each foot supporting link 150 also includes a foot platform 155 which extends in cantilevered fashion from the second portion of a respective link 150. Each foot platform 155 is sized and configured to support a person's foot. The size and configuration of the foot supporting links 150 are such that each foot platform 155 is constrained to move through an elliptical path (designated as P2 in FIG. 2 and as P3 in FIG. 3) which varies according to the orientation of the guide 160. As compared to the exercise apparatus disclosed in U.S. Pat. No. 5,685,804 to Whan-Tong et al., the foot platforms 155 provides more comfortable foot motion, particularly when the guide 160 occupies the position shown in FIG. 2. Each of the elliptical paths P2 and P3 has a major axis which is greater than the diameter defined by the cranks 123 and 120.

Another advantage of the present invention is that the apparatus 100 may be conveniently approached and mounted from the rear. A person places a respective foot on each of the foot platforms 155 and begins moving his or her feet through striding motions. The linkage assembly constrains the person's feet to move through elliptical paths (such as P2 or P3) while the cranks 123 and 120 rotate relative to the frame 110. Those skilled in the art will recognize that handles may be rigidly secured to any of the moving links and/or movably secured to the frame 110 to provide arm exercise motion contemporaneous with leg exercise motion.

Figure 4:
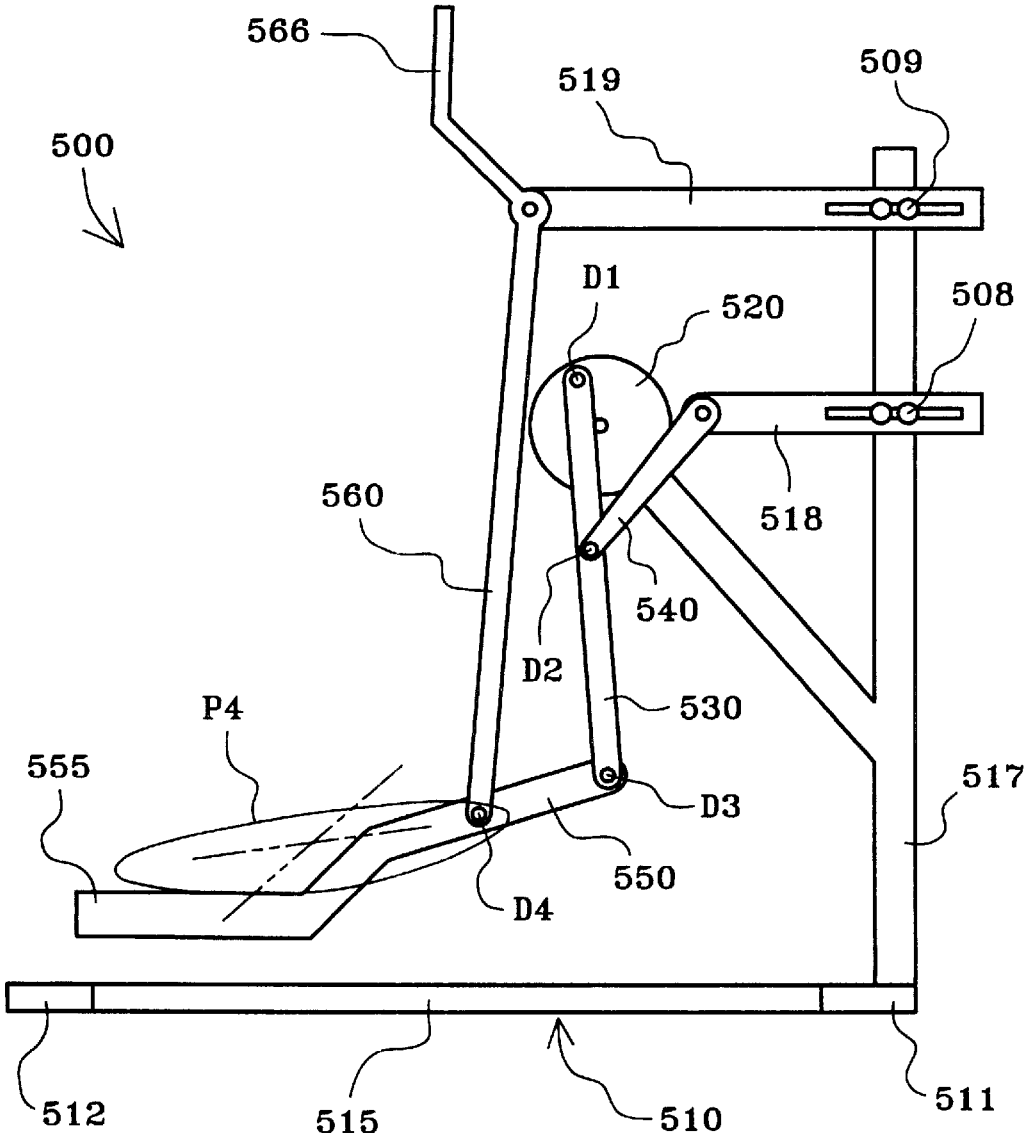
FIG. 4 is a side view of a second exercise apparatus constructed according to the principles of the present invention.

A second embodiment of the present invention is designated as 500 in FIG. 4. The exercise apparatus 500 includes a frame 510 having a base 515 which extends from a front end 511 to a rear end 512, and which is designed to occupy a fixed position relative to a floor surface. A stanchion 517 extends upward from the base 515, proximate the front end 511. Left and right connector links 530 have (a) first connection points D1 rotatably connected to respective cranks 520, which in turn, are rotatably mounted on opposite sides of the stanchion 517; (b) second connection points D2 rotatably connected to respective rocker links 540, which in turn, are rotatably connected to opposite sides of the stanchion 517; and (c) third connection points D3 rotatably connected to forward ends of respective foot supporting links 550.

A rearward, cantilevered end 555 of each foot supporting link 550 is sized and configured to support a respective foot of a standing person. An intermediate portion of each foot supporting link 550 is rotatably connected to a lower end of a respective rocker link 560. An intermediate portion of each rocker link 560 is rotatably connected to the stanchion 517, and an upper end 566 of each rocker link 560 is sized and configured for grasping.

Each connector link 530 constrains a first portion of a respective foot supporting link 550 (at D3) to move through an elliptical path, and each rocker link 560 constrains a second portion of a respective foot supporting link 550 (at D4) to move through a discrete predetermined path. The resulting linkage assembly links rotation of the cranks 520 to generally elliptical movement of the foot supports 555 through the path designated as P4.

The pivot axes of the rocker links 540 and/or the rocker links 560 may be adjusted relative to the frame 510 to change the path of exercise motion. On the embodiment 500, for example, each rocker link 540 or 560 is rotatably connected to a respective bracket 518 or 519, which in turn, is movable horizontally relative to the stanchion 517. Slots in the brackets 518 and 519 provide the necessary degree of freedom, and fasteners 508 and 509 releasably lock the respective brackets 518 and 519 in place.

Figure 5:
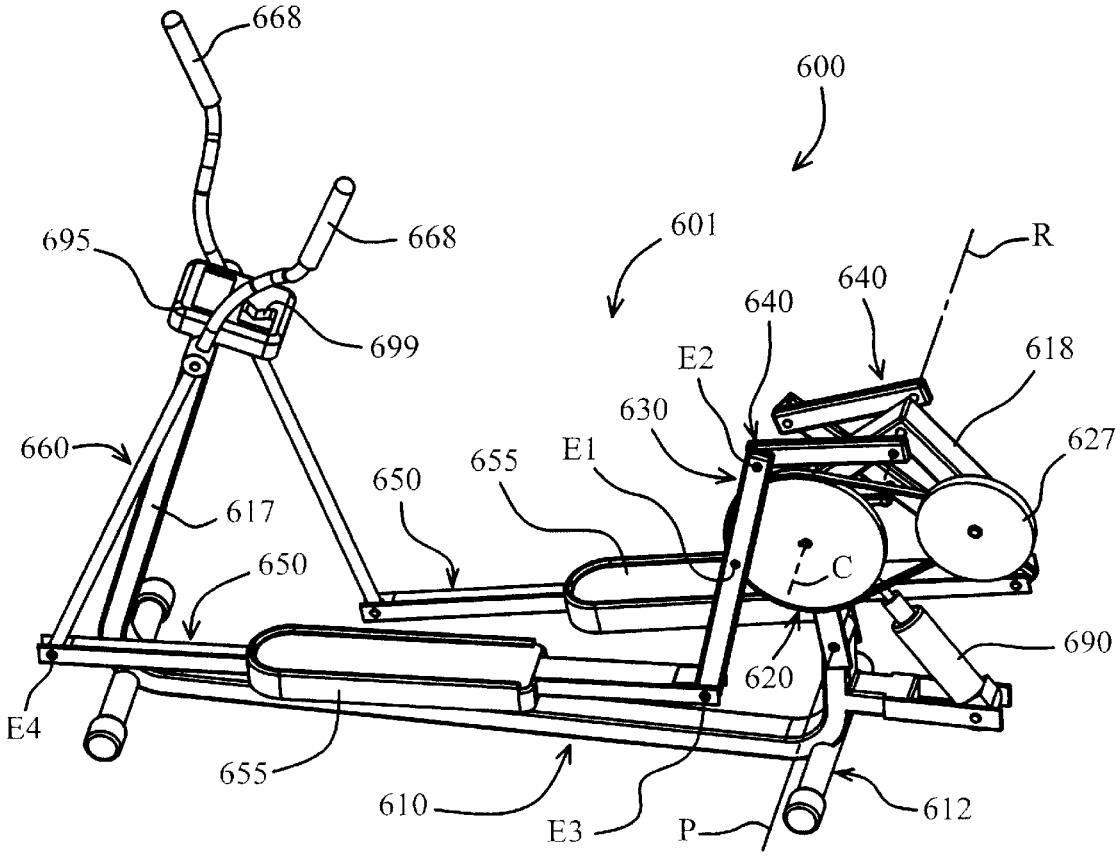
FIG. 5 is a perspective view of a third exercise apparatus constructed according to the principles of the present invention.

Yet another embodiment of the present invention is designated as 600 in FIG. 5. The exercise apparatus 600 has a frame 610 which includes a base 612 designed to rest upon a floor surface. A forward stanchion or support 617 extends upward from the base 612 proximate the front end thereof, and a rearward stanchion or support 618 extends upward from the base 612 proximate the rear end thereof. The rearward support 618 is generally U-shaped and is pivotally mounted to the base 612, thereby defining a pivot axis P. Those skilled in the art will recognize that the stanchion 617 may be modified to rotate relative to the base 612 in order to make the apparatus 600 more compact for purposes of storage and/or transportation.

Left and right cranks 620 (the former in the form of a large diameter pulley, and the latter in the form of a crank arm) are rotatably mounted on the support 618, thereby defining a crank axis C. A flywheel 627 is also rotatably mounted on the support 618 and is connected to the left crank 620 in a manner which provides a stepped-up flywheel arrangement. Resistance to rotation of the flywheel 627 is also provided by means known in the art.

Left and right connector links 630 have first or upper ends which are constrained to move in reciprocal fashion relative to the support 618 (at connection points E2). In particular, left and right rocker links 640 are rotatably connected between the support 618 and respective links 630. The rocker links 640 rotate about a rocker axis R relative to the support 618. The connector links 630 have intermediate portions which are rotatably connected to respective cranks 620 (at connection points E1), and the connector links 630 have opposite, lower ends which are rotatably connected to rearward ends of respective foot supporting links 650 (at connection points E3).

The foot supporting links 650 have intermediate portions 655 which are sized and configured to support a person's feet, and forward ends which are rotatably connected to lower ends of respective rocker links 660 (at connection points E4). The rocker links 660 have intermediate portions which are rotatably mounted on the forward support 617, and upper ends 668 which are sized and configured for grasping by a person standing on the foot supporting portions 655 of the horizontal links 650. In the alternative, the intermediate portion of each rocker link 660 could be rotatably connected to a frame member which in turn, is slidably mounted on the stanchion 617 for adjustment purposes. In any event, each rocker link 660 may be described as a means for constraining the forward end of a respective foot supporting link 650 to move in reciprocating fashion relative to the frame 610 and/or as a discrete force receiving means.

The resulting assembly 601 constrains the foot supporting members 655 to move through generally elliptical paths of motion contemporaneously with rotation of the cranks 620. A linear actuator 690 is rotatably interconnected between the rearward support 618 and a bracket on the base 612 and is operable to pivot the former relative to the latter. Such pivoting causes both the crank axis C and rocker axis R to move relative to the remainder of the linkage assembly 601 and thereby alters the configuration of the paths traveled by the foot supporting members 655. An advantage of this particular adjustment means is that the location of the foot paths remains generally fixed relative to the base 612 throughout the range of adjustment.

The actuator 690 is connected to a user interface device 695 mounted on the forward support 617. The device 695 includes an input device 699 which is linked to the actuator 690 and movable to operate same. In other words, the person may make the exercise strokes longer or shorter (as measured fore to aft) simply by pushing the button or switch 699. Those skilled in the art will recognize that the switch 699 could be replaced by other suitable means, including a knob, for example, which would not only rotate to make adjustments but also, would cooperate with indicia on the device 695 to indicate the current level of adjustment.

Those skilled in the art will recognize that the configuration of the links and/or the locations of axes or connection points may be varied without departing from the scope of the present invention. For example, alternative embodiments may be designed with the rocker axis R forward of the crank axis and/or beneath the crank axis C. In general, a relatively high rocker axis (as on the apparatus 600) provides more favorable adjustability of the exercise stroke (i.e. increases in size accompanied by relatively small variations in shape), and a relatively low rocker axis provides more favorable "feeling" in the exercise stroke (i.e. a relatively slower power stroke followed by a relatively quicker return stroke).

Figure 6:
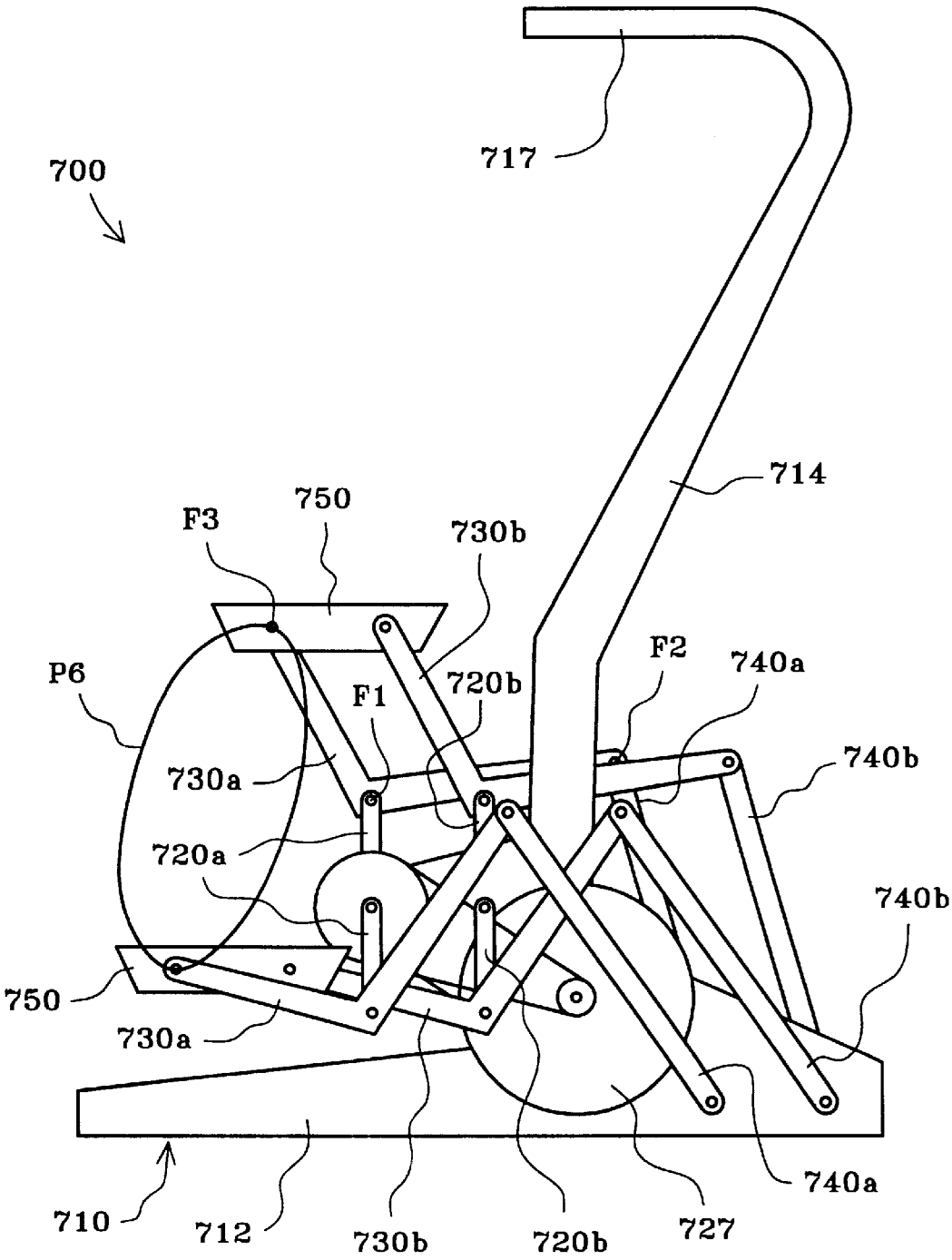
FIG. 6 is a side view of a fourth exercise apparatus constructed according to the principles of the present invention.

Still another embodiment of the present invention is designated as 700 in FIG. 6. The exercise apparatus 700 includes a frame 710 and a linkage assembly movably mounted on the frame 710. The frame 710 includes a base 712 designed to rest upon a floor surface; a stanchion 714 extending upward from the base 712; and fixed handle bars 717 extending rearward from an upper end of the stanchion 714.

On each side of the apparatus 700, first connector links 730*a* have first connection points F1 rotatably connected to respective first cranks 720*a;* second connection points F2 rotatably connected to respective first rocker links 740*a;* and third connection points F3 rotatably connected to respective foot supporting links 750. Rotation of the crank arms 720*a* relative to the frame 710 is linked to reciprocal pivoting of the rocker links 730*a* and movement of the connection points F3 (and the foot supports 750) through generally elliptical paths of motion designated as P6.

A discrete portion of each foot supporting link 750 is constrained to move through a predetermined path (in this case, a path similar in size and shape to the path P6) by means of second connector links 730*b,* second cranks 720*b,* and second rocker links 740*b,* which are connected in the same fashion as their counterparts 730*a,* 720*a,* and 740*a*. These dual linkage assemblies maintain the foot supports 750 in a horizontal orientation throughout an exercise cycle. At least one of the cranks 720*a* and 720*b* is operatively connected to a "stepped up" flywheel 727.

Those skilled in the art will recognize that the present invention may also described in terms of various methods (with reference to manufacture of the foregoing embodiments, for example). One such method may be described in terms of making an exercise apparatus which links rotation of a crank to generally elliptical movement of a foot supporting member. The method includes the steps of providing a frame to rest upon a floor surface; rotatably mounting left and right cranks on the frame; rotatably mounting first connection points on first and second connector links to respective cranks; constraining second connection points on respective connector links to move through predetermined paths relative to the frame; rotatably connecting first portions of left and right foot supporting links to third connection points on respective connector links; and constraining second portions of the foot supporting members to move through predetermined paths relative to the frame. The method may further include the step of changing the location of one or more frame members, in order to adjust the path traveled by the foot supporting member.

Those skilled in the art will recognize additional methods and/or embodiments which differ from those described herein yet nonetheless fall within the scope of the present invention. Among other things, the disclosed linkage assemblies are useful independent of the direction of exercise and/or the orientation of the user. Also, certain components of the linkage assemblies may be replaced by alternative mechanisms. For example, the rockers 140, 540, 640, 740*a,* and/or 740*b* may be replaced by other reciprocal motion linkages, including sliding members or rolling members. Recognizing that the foregoing description sets forth only some of the numerous possibilities, the scope of the present invention is to be limited only to the extent of the claims which follow.

What is claimed is:

1. An exercise apparatus, comprising:

a frame designed to occupy a fixed position relative to a floor surface;

a left guide and a right guide, wherein each said guide is mounted on a respective side of said frame;

a left crank and a right crank, wherein each said crank is mounted on a respective side of said frame and rotatable relative thereto about a common crank axis;

a left rocker link and a right rocker link, wherein each said rocker link is mounted on a respective side of said frame and pivotal relative thereto about a common rocker axis;

a left foot supporting link and a right foot supporting link, wherein each said foot supporting link has a forward end, an intermediate portion, and a rearward end, and each said intermediate portion is rollable along a respective guide, and each said rearward end is sized and configured to support a person's foot; and a left connector link and a right connector link, wherein a first portion of each said connector link is rotatably connected to a respective crank, and a second portion of each said connector link is rotatably connected to a respective rocker link, and a third portion of each said connector link is rotatably connected to the forward end of a respective foot supporting link.

2. The exercise apparatus of claim 1, further comprising a means for adjusting each said guide relative to said frame.

3. The exercise apparatus of claim 2, wherein each said guide is pivotally connected to said frame, and said means selectively pivots each said guide relative to said frame.

4. The exercise apparatus of claim 1, wherein each said guide is pivotally connected to said frame at a common pivot axis, and further comprising an adjustable length member interconnected between each said guide and said frame at a distance apart from said pivot axis.

5. The exercise apparatus of claim 1, wherein each said foot supporting link includes first and second segments which define an angle at a respective intermediate portion.

6. The exercise apparatus of claim 1, wherein an intermediate portion of each said connector link is rotatably connected to a respective crank.

7. The exercise apparatus of claim 6, wherein an upper end of each said connector link is rotatably connected to a respective rocker link.

* * * * *